US011257344B1

(12) United States Patent
Woods

(10) Patent No.: US 11,257,344 B1
(45) Date of Patent: Feb. 22, 2022

(54) UNATTENDED CHILD ALERT DEVICE FOR VEHICLES

(71) Applicant: Tyrone Woods, Brooklyn, NY (US)

(72) Inventor: Tyrone Woods, Brooklyn, NY (US)

( * ) Notice: Subject to any disclaimer, the term of this patent is extended or adjusted under 35 U.S.C. 154(b) by 0 days.

(21) Appl. No.: 16/922,006

(22) Filed: Jul. 7, 2020

(51) Int. Cl.
*G08B 21/02* (2006.01)

(52) U.S. Cl.
CPC ..... *G08B 21/0291* (2013.01); *G08B 21/023* (2013.01)

(58) Field of Classification Search
None
See application file for complete search history.

(56) References Cited

U.S. PATENT DOCUMENTS 4,330,123 A * 5/1982 Kleinerman ..... A63B 69/0046 434/249
6,535,137 B1 3/2003 Ryan
7,012,533 B2 3/2006 Younse
7,106,207 B1 9/2006 Marchan
7,786,852 B2 8/2010 Kautz
8,063,758 B1 11/2011 Mohan
8,847,747 B2 9/2014 Bloukos
9,845,050 B1 * 12/2017 Garza ..... B60Q 9/00
2003/0122662 A1 7/2003 Quinonez
2005/0180128 A1 * 8/2005 Sinegal ..... A42B 1/244 362/105
2006/0103525 A1 5/2006 Mger
2011/0080288 A1 4/2011 Younse
2015/0274036 A1 * 10/2015 Arad ..... B60N 2/002 340/573.1
2016/0049060 A1 2/2016 Bernes
2016/0260532 A1 * 9/2016 Baca ..... H01F 7/0252
2021/0129625 A1 * 5/2021 Donboli ..... B60H 1/00807

FOREIGN PATENT DOCUMENTS

WO 2015044885 4/2015

* cited by examiner

*Primary Examiner* — John F Mortell

(57) ABSTRACT

The unattended child alert device for vehicle mounts on the door into the passenger compartment of the automobile such that the unattended child alert device for vehicle is positioned in the passenger compartment. The unattended child alert device for vehicle monitors detects when the door is opened and closed. The unattended child alert device for vehicle monitors makes an audible announcement when the door of the automobile is opened. The unattended child alert device for vehicle monitors makes an audible announcement when the door of the automobile is closed. The audible announcement is a spoken message that tells the operator of the automobile to remember their children. The unattended child alert device for vehicle further records short spoken messages that the operator of the automobile would like recorded. The unattended child alert device for vehicle comprises a housing and a control circuit. The housing contains the control circuit.

16 Claims, 5 Drawing Sheets

UNATTENDED CHILD ALERT DEVICE FOR VEHICLES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transportation and vehicles, more specifically, a passenger detection system. (B60N2/002)

SUMMARY OF INVENTION

The unattended child alert device for vehicle is an electric device. The unattended child alert device for vehicle is configured for use with an automobile. The unattended child alert device for vehicle mounts on the door into the passenger compartment of the automobile such that the unattended child alert device for vehicle is positioned in the passenger compartment when the door is closed. The unattended child alert device for vehicle monitors and detects when the door is opened and closed. The unattended child alert device for vehicle monitors makes an audible announcement when the vehicle of the door is opened. The unattended child alert device for vehicle monitors makes an audible announcement when the door of the automobile is closed. The audible announcement is a spoken message that tells the operator of the automobile to remember their children. The unattended child alert device for vehicle further records short spoken messages that the operator of the automobile would like recorded. The unattended child alert device for vehicle comprises a housing and a control circuit. The housing contains the control circuit.

These together with additional objects, features and advantages of the unattended child alert device for vehicle will be readily apparent to those of ordinary skill in the art upon reading the following detailed description of the presently preferred, but nonetheless illustrative, embodiments when taken in conjunction with the accompanying drawings.

In this respect, before explaining the current embodiments of the unattended child alert device for vehicle in detail, it is to be understood that the unattended child alert device for vehicle is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the unattended child alert device for vehicle.

It is therefore important that the claims be regarded as including such equivalent construction insofar as they do not depart from the spirit and scope of the unattended child alert device for vehicle. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
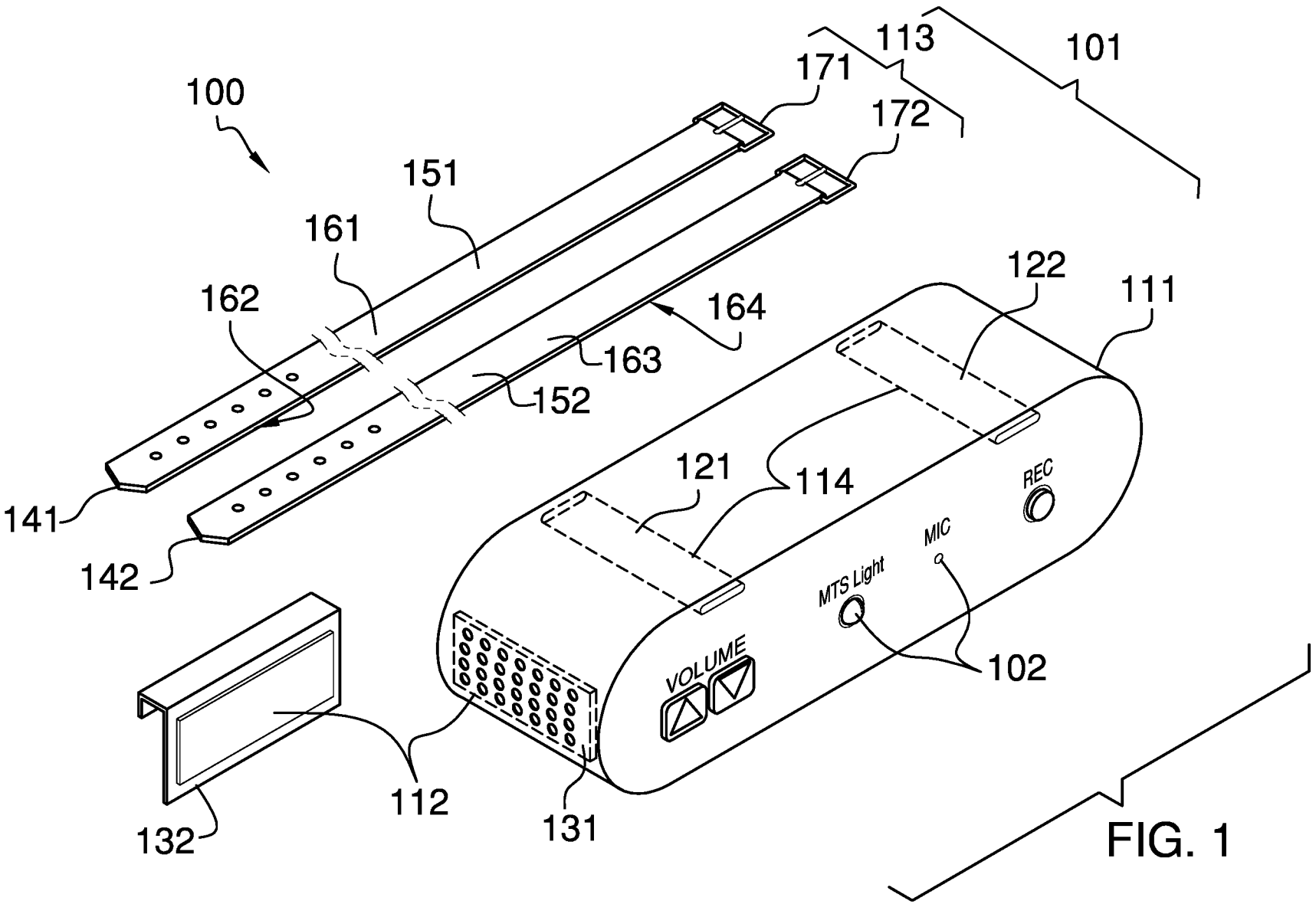
FIG. 1 is a perspective view of an embodiment of the disclosure.
Figure 2:
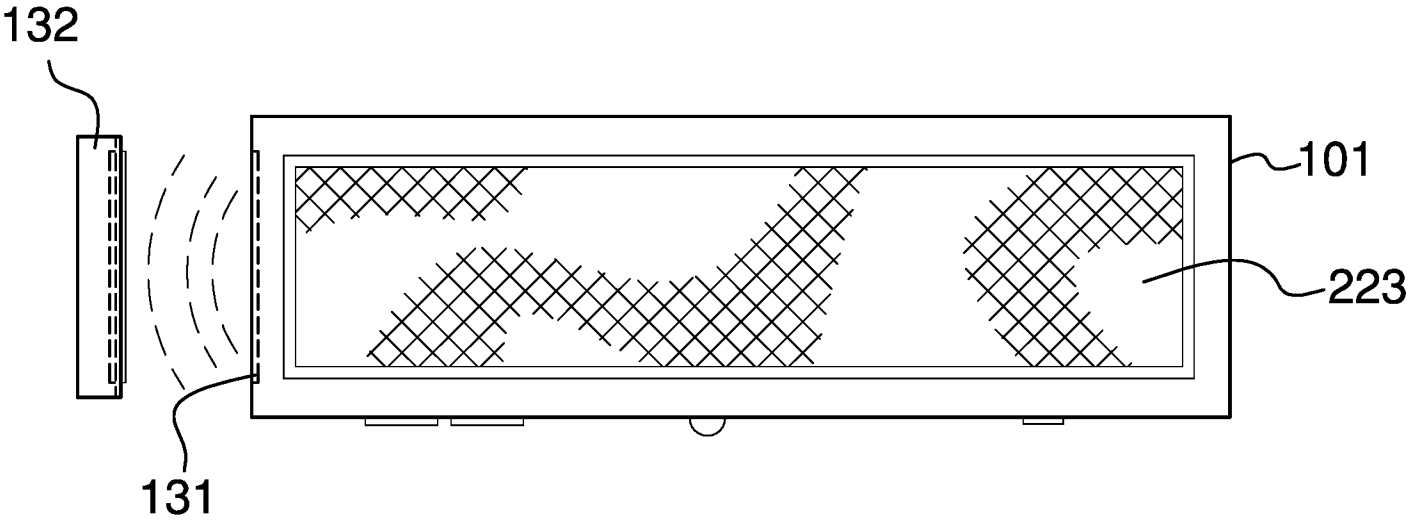
FIG. 2 is a bottom view of an embodiment of the disclosure.
Figure 3:
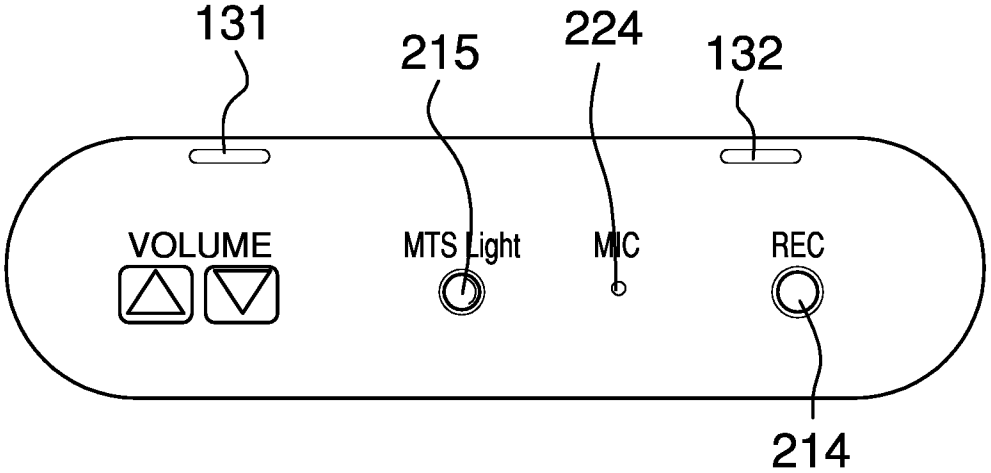
FIG. 3 is a front view of an embodiment of the disclosure.
Figure 4:
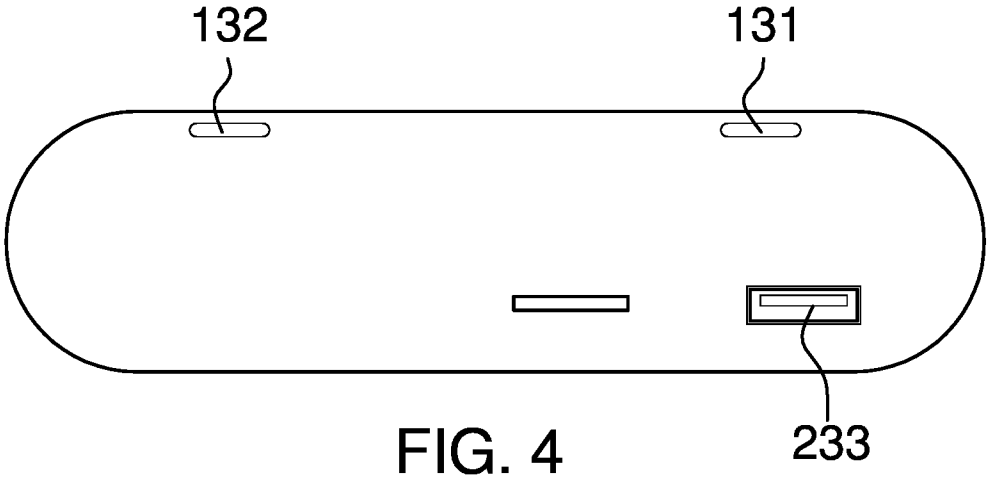
FIG. 4 is a rear view of an embodiment of the disclosure.
Figure 5:
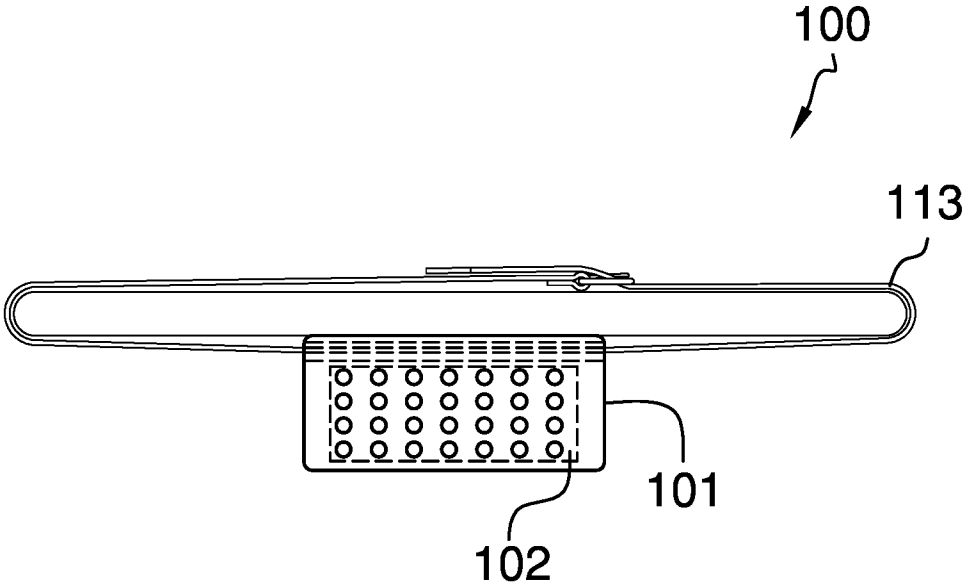
FIG. 5 is a side view of an embodiment of the disclosure.
Figure 6:
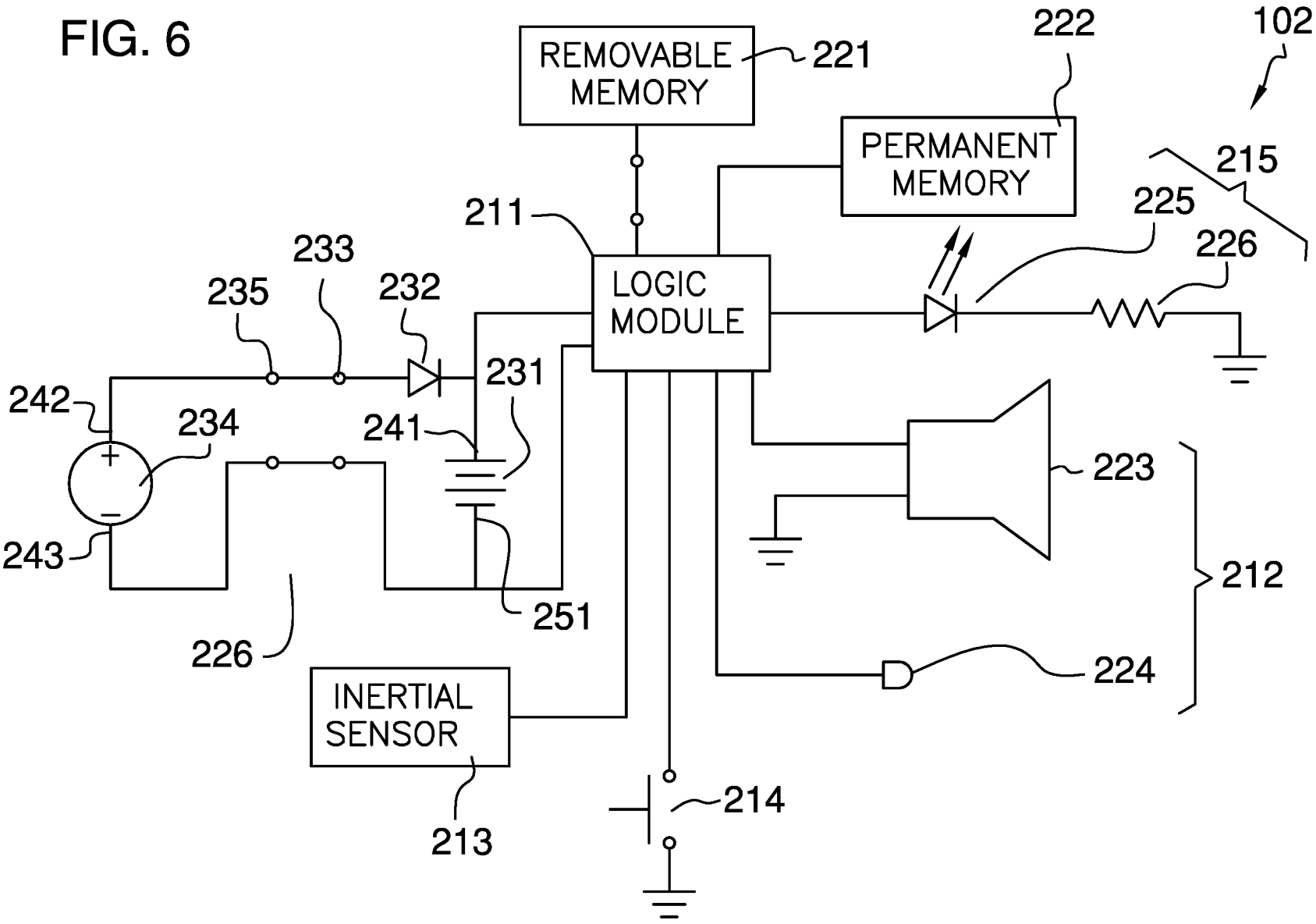
FIG. 6 is a schematic view of an embodiment of the disclosure.

Detailed reference will now be made to one or more potential embodiments of the disclosure, which are illustrated in FIGS. 1 through 6.

The unattended child alert device for vehicle 100 (hereinafter invention) is an electric device. The invention 100 is configured for use with an automobile. The invention 100 mounts on the door into the passenger compartment of the automobile such that the invention 100 is positioned in the passenger compartment when the door is closed. The invention 100 monitors and detects when the door is opened and closed. The invention 100 monitors makes an audible announcement when the door of the automobile is opened. The invention 100 monitors makes an audible announcement when the automobile of the door is closed. The audible announcement is a spoken message that tells the operator of the automobile to remember their children. The invention 100 further records short spoken messages that the operator of the automobile would like recorded. The invention 100 comprises a housing 101 and a control circuit 102. The housing 101 contains the control circuit 102. The control circuit 102 monitors and detects a change of inertia in the housing 101 to determine if the door has been opened or closed.

The housing 101 is a rigid casing. The housing 101 contains the control circuit 102. The housing 101 is formed with all apertures and form factors necessary to allow the housing 101 to accommodate the use and operation of the control circuit 102. Methods to form a housing 101 suitable for the purposes described in this disclosure are well-known and documented in the mechanical arts. The housing 101 comprises a shell 111, a plurality of magnets 112, and a plurality of hook and loop fasteners 113.

The shell 111 is a rigid casing. The shell 111 contains the control circuit 102. The shell 111 is formed with all apertures and form factors necessary to allow the shell 111 to accommodate the use and operation of the control circuit 102. Methods to form a shell 111 suitable for the purposes described in this disclosure are well-known and documented in the mechanical arts. The shell 111 further comprises a plurality of webbing channels 114. Each of the plurality of webbing channels 114 is a channel that is formed in the shell 111. The term channel is defined elsewhere in this disclosure. The plurality of webbing channels 114 further comprises a first webbing 151 channel 121 and a second webbing 152 channel 122.

The first webbing 151 channel 121 is a channel that is formed in the shell 111. The first webbing 151 channel 121 is sized to receive a first hook and loop fastener 141 selected from the plurality of hook and loop fasteners 113. A selected first hook and loop fastener 141 inserts through the first webbing 151 channel 121 to secure the first hook and loop fastener 141 to the first webbing 151 channel 121. The second webbing 152 channel 122 is a channel that is formed in the shell 111. The second webbing 152 channel 122 is sized to receive a second hook and loop fastener 142 selected from the plurality hook and loop fasteners 113. A selected second hook and loop fastener 142 inserts through the second webbing 152 channel 122 to secure the second hook and loop fastener 142 to the second webbing 152 channel 122.

The plurality of magnets 112 magnetically secure the shell 111 to a surface within the automobile. An initial magnet selected from the plurality of magnets 112 attaches to the exterior surface of the shell 111. A subsequent magnet selected from the plurality of magnets 112 attaches to the surface to which the invention 100 attaches. The plurality of magnets 112 secures the invention 100 to the surface within the automobile by placing the initially selected magnet against the subsequently selected magnet. The plurality of magnets 112 comprises a first magnet 131 and a second magnet 132.

The first magnet 131 is a metallic structure that displays magnetic properties. The first magnet 131 is the initial magnet selected from the plurality of magnets 112 that attaches to the exterior surface of the shell 111 of the housing 101. The second magnet 132 is a metallic structure that displays magnetic properties. The second magnet 132 is the subsequent magnet selected from the plurality of magnets 112 that attaches to a surface in the automobile. The first magnet 131 presses against the second magnet 132 to secure the invention 100 to the surface.

Each of the plurality of hook and loop fasteners 113 is a fastening device. Each of the plurality of hook and loop fasteners 113 secures the shell 111 to a structure within the automobile. The structure is selected such that a change in the inertia of the structure would appropriately initiate the operation of the audible announcement. The plurality of hook and loop fasteners 113 comprises the first hook and loop fastener 141 and the second hook and loop fastener 142.

The first hook and loop fastener 141 is the hook and loop fastener selected from the plurality of hook and loop fasteners 113 that inserts through the first webbing 151 channel 121 of the shell 111. The first hook and loop fastener 141 secures the shell 111 to an object within the automobile. The first hook and loop fastener 141 comprises a first webbing 151 and a first ring 171. The first webbing 151 further comprises a first hook/loop surface 161 and a second hook/loop surface 162.

The first webbing 151 is a textile-based webbing structure. The first webbing 151 forms the primary structure of the first hook and loop fastener 141. The first webbing 151 attaches to itself using to form a loop that secures the shell 111 to an object.

The first hook/loop surface 161 is a hook/loop surface of the first hook and loop fastener 141 that is formed on a face of the first webbing 151 of the first hook and loop fastener 141. The second hook/loop surface 162 is a hook/loop surface of the first hook and loop fastener 141 that is formed on the face of the first webbing 151 of the first hook and loop fastener 141 that is distal from the face that has the first hook/loop surface 161.

The first ring 171 is a ring structure. The first ring 171 attaches to an end of the first webbing 151. The first ring 171 forms a mechanical structure that allows the first webbing 151 to loop back upon itself.

The second hook and loop fastener 142 is the hook and loop fastener selected from the plurality of hook and loop fasteners 113 that inserts through the second webbing 152 channel 122 of the shell 111. The second hook and loop fastener 142 secures the shell 111 to an object within the automobile. The second hook and loop fastener 142 comprises a second webbing 152 and a second ring 172. The second webbing 152 further comprises a third hook/loop surface 163 and a fourth hook/loop surface 164.

The second webbing 152 is a textile-based webbing structure. The second webbing 152 forms the primary structure of the second webbing 152. The second webbing 152 attaches to itself using to form a loop that secures the shell 111 to an object.

The third hook/loop surface 163 is a hook/loop surface of the second hook and loop fastener 142 that is formed on a face of the second webbing 152 of the second hook and loop fastener 142. The fourth hook/loop surface 164 is a hook/loop surface of the second hook and loop fastener 142 that is formed on the face of the second webbing 152 of the second hook and loop fastener 142 that is distal from the face that has the third hook/loop surface 163.

The second ring 172 is a ring structure. The second ring 172 attaches to an end of the second webbing 152. The second ring 172 forms a mechanical structure that allows the second webbing 152 to loop back upon itself.

The first hook and loop fastener 141 binds the housing 101 to an object by: a) inserting the end of the first webbing 151 that is distal from the first ring 171 through the first webbing 151 channel 121; b) subsequently inserting the end of the first webbing 151 that is distal from the first ring 171 through the first ring 171; and then c) pressing the first hook/loop surface 161 against the second hook/loop surface 162.

The second hook and loop fastener 142 binds the housing 101 to an object by: a) inserting the end of the second webbing 152 that is distal from the second ring 172 through the second webbing 152 channel 122; b) subsequently inserting the end of the second webbing 152 that is distal from the second ring 172 through the second ring 172; and then c) pressing the third hook/loop surface 163 against the fourth hook/loop surface 164.

The control circuit 102 is an electric circuit. The control circuit 102 contains the housing 101. The control circuit 102 monitors the inertia of the housing 101. The control circuit 102 generates an audible announcement when the control circuit 102 detects a change in the inertia of the housing 101. The control circuit 102 records audible messages dictated from the exterior of the housing 101. The control circuit 102 is an independently powered electric circuit. By independently powered is meant that the control circuit 102 can operate without an electrical connection to an external power source 234. The control circuit 102 comprises a logic module 211, a plurality of transducers 212, an inertial sensor 213, a record switch 214, and a recording signal 215. The logic module 211, the plurality of transducers 212, the inertial sensor 213, the record switch 214, and the recording signal 215 are electrically interconnected.

The logic module 211 is an electric circuit. The logic module 211 controls the operation of the control circuit 102. The logic module 211 controls, monitors, and powers the operation of the plurality of transducers 212. The logic module 211 monitors and powers the operation of the inertial sensor 213. The logic module 211 monitors the operation of the record switch 214. The logic module 211 illuminates the recording signal 215. The logic module 211 draws electric energy from the power circuit 216. The logic module 211 monitors the inertia of the housing 101 using the inertial sensor 213. The logic module 211 generates an audible announcement when the logic module 211 detects a change in the inertia of the inertial sensor 213 using a transducer selected from the plurality of transducers 212. The logic module 211 records acoustic energy captured from the exterior of the housing 101 using a transducer selected from the plurality of transducers 212.

The logic module 211 further comprises a removable memory device 221 and a permanent memory device 222. The removable memory device 221 is a memory device. The memory device is defined elsewhere in this disclosure. The removable memory device 221 forms a temporary electrical connection with the logic module 211. The logic module 211 controls the operation of the removable memory device 221. The removable memory device 221 stores audio files generated by the logic module 211 of the acoustic energy detected by the microphone 224. The permanent memory device 222 is a memory device. The memory device is defined elsewhere in this disclosure. The permanent memory device 222 forms a permanent electrical connection with the logic module 211. The logic module 211 controls the operation of the permanent memory device 222. The permanent memory device 222 stores audio files used by the logic module 211 to generate the audible announcement that is announced over the speaker 223 by the logic module 211.

Each of the plurality of transducers 212 is an electrical device. Each of the plurality of transducers 212 performs a function selected from the group consisting of: a) converting mechanical energy into electrical energy; and, b) converting electrical energy into mechanical energy. The plurality of transducers 212 further comprises a speaker 223 and a microphone 224. The speaker 223 is a transducer selected from the plurality of transducers 212. The speaker 223 converts electric energy received from the logic module 211 into acoustic energy used to create the audible announcement. The microphone 224 is a transducer selected from the plurality of transducers 212. The microphone 224 converts acoustic energy captured from the exterior of the housing 101 into electrical energy that is transmitted to the logic module 211.

The inertial sensor 213 is a sensor. The inertial sensor 213 is a type of force sensor. The inertial sensor 213 converts changes in the inertia of the housing 101 into electrical signals that are transmitted to the logic module 211. The logic module 211 generates the audible announcement when the logic module 211 determines that the inertial sensor 213 had detected a change in inertia. The logic module 211 generates the audible announcement using the speaker 223 from an audio file that is stored on the permanent memory device 222 of the logic module 211.

The record switch 214 is a momentary switch. The logic module 211 monitors the operation of the record switch 214. The actuation of the record switch 214 causes the logic module 211 to begin recording the acoustic energy detected by the microphone 224 into an audio file that is stored on the removable memory device 221 of the logic module 211. The actuation of the record switch 214 causes the logic module 211 to discontinue recording the acoustic energy detected by the microphone 224.

The recording signal 215 is an electric circuit that generates an illumination. The logic module 211 controls the operation of the recording signal 215 such that the recording signal 215 is illuminated when the logic module 211 is recording the acoustic energy detected by the microphone 224. The recording signal 215 extinguishes the recording signal 215 when the logic module 211 is not recording the acoustic energy detected by the microphone 224. The recording signal 215 further comprises an LED 225 and a limit resistor 226.

The LED 225 is a two-terminal semiconducting device. The LED 225 electrically connects to the logic module 211 such that the logic module 211 controls the operation of the LED 225. The LED 225 illuminates when the logic module 211 sends an electric current through the LED 225. The limit resistor 226 is an electric circuit element that forms a series connection with the LED 225. The limit resistor 226 limits the amount of electric energy that flows through the LED 225.

The power circuit 216 is an electrical circuit. The power circuit 216 powers the operation of the control circuit 102. The power circuit 216 is an electrochemical device. The power circuit 216 converts chemical potential energy into the electrical energy required to power the control circuit 102. The power circuit 216 comprises a battery 231, a diode 232, a charging port 233, and an external power source 234. The external power source 234 further comprises an external power source 234, a second positive terminal 242, and a second negative terminal 252. The battery 231, the diode 232, the charging port 233, the external power source 234, and the charging port 235 are electrically interconnected. The battery 231 further comprises a first positive terminal 241 and a second positive terminal 242.

The battery 231 is an electrochemical device. The battery 231 converts chemical potential energy into the electrical energy used to power the control circuit 102. The battery 231 is a commercially available rechargeable battery 231. The chemical energy stored within the rechargeable battery 231 is renewed and restored through the use of the charging port 233. The charging port 233 is an electrical circuit that reverses the polarity of the rechargeable battery 231 and provides the energy necessary to reverse the chemical processes that the rechargeable battery 231 initially used to generate the electrical energy. This reversal of the chemical process creates a chemical potential energy that will later be used by the rechargeable battery 231 to generate electricity.

The charging port 233 forms an electrical connection to an external power source 234 using a charging plug 235. The charging plug 235 forms a detachable electrical connection with the charging port 233. The charging port 233 receives electrical energy from the external power source 234 through the charging plug 235. The diode 232 is an electrical device that allows current to flow in only one direction. The diode 232 installs between the rechargeable battery 231 and the charging port 233 such that electricity will not flow from the first positive terminal 241 of the rechargeable battery 231 into the second positive terminal 242 of the external power source 234. In the first potential embodiment of the disclosure, the external power source 234, the charging plug 235, and the charging port 233 are compatible with USB power requirements.

The following definitions were used in this disclosure:

Audio: As used in this disclosure, audio refers to the reproduction of a sound that simulates the sound that was originally created.

Audio Device: As used in this disclosure, an audio device is a device that generates audible sound waves.

Audio File: As used in this disclosure, an audio file is a digital representation of a sound that is used to store a recording of the sound. Separate hardware is used to convert the digital representation of the sound into an audible sound.

Audio Source: As used in this disclosure, an audio source is a device that generates electrical signals that can be converted into audible sounds by an audio device such as a speaker.

Battery: As used in this disclosure, a battery is a chemical device consisting of one or more cells, in which chemical energy is converted into electricity and used as a source of power. Batteries are commonly defined with a positive terminal and a negative terminal.

Bind: As used in this disclosure, to bind is a verb that means to tie or secure a first object to a second object using a strap, cord, or webbing.

Channel: As used in this disclosure, a channel is a negative space that forms a prism-shaped passage through which an object or fluid passes through.

Control Circuit: As used in this disclosure, a control circuit is an electrical circuit that manages and regulates the behavior or operation of a device.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

External Power Source: As used in this disclosure, an external power source is a source of the energy that is externally provided to enable the operation of the present disclosure. Examples of external power sources include, but are not limited to, electrical power sources and compressed air sources.

Fastener: As used in this disclosure, a fastener is a device that is used to removably attach a first object to a second object.

Force Sensor: As used in this disclosure, the force sensor is a sensor that generates an electrically measurable signal that is a function of the amount of force applied to the force sensor.

Form Factor: As used in this disclosure, the term form factor refers to the size and shape of an object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Housing: As used in this disclosure, a housing is a rigid structure that encloses and protects one or more devices.

Inertia: As used in this disclosure, the term inertia refers to an object that is not under the influence of an accelerating force. By under the influence is meant that the velocity of the object maintains a constant speed and direction (i.e. the object is not under acceleration or deceleration).

Inertial Sensor: As used in this disclosure, an inertial sensor is a form of a force sensor that measures the change in the inertia of an object.

LED: As used in this disclosure, an LED is an acronym for a light emitting diode. A light emitting diode is a diode that is also a light source.

Limit Resistor: As used in this disclosure, a limit resistor is an electrical resistor that is used to limit the flow of electric current through an electrical circuit.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Magnet: As used in this disclosure, a magnet is an ore, alloy, or other material that has its component atoms arranged so the material exhibits properties of magnetism such as: 1) attracting other iron-containing objects; 2) attracting other magnets; or, 3) or aligning itself in an external magnetic field.

Memory Device: As used in this device, a memory device is an electronic device that stores information (including audio and video data) in a digital format. Common memory devices include the RAM (random access memory) and disk drives in a computer, USB (Universal Serial Bus) drives, DVD (Digital Video Disk) formatted video, and SD (secure digital) cards.

Microphone: As used in this disclosure, a microphone is a transducer that converts the energy from vibration into electrical energy. The sources of vibrations include, but are not limited to, acoustic energy.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Resistance: As used in this disclosure, resistance refers to the opposition provided by an electrical circuit (or circuit element) to the electrical current created by a DC voltage is presented across the electrical circuit (or circuit element). The term impedance is often used for resistance when referring to an AC voltage that is presented across the electrical circuit (or circuit element).

Resistor: As used in this disclosure, a resistor is a well-known and commonly available electrical device that presents a resistance that inhibits the flow of electricity through an electric circuit. Within an electric circuit processing alternating currents, the resistor will not affect the phase of the alternating current. A current flowing through a resistor will create a voltage across the terminals of the resistor.

Ring: As used in this disclosure, a ring is term that is used to describe a disk-like structure through which a negative space is formed. Rings are often considered loops.

Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Series Circuit: As used in this disclosure, a series circuit refers to a method of electrically connecting a plurality of circuit elements to a voltage source. In a series circuit, the proportion of the voltage received by each individual circuit element is divided proportionally between the plurality circuit elements based on the resistance (or impedance) of each circuit element relative to the total resistance of the plurality of circuit elements. The series circuit forms a linear or loop structure often referred to as a daisy chain.

Shell: As used in this disclosure, a shell is a structure that forms an outer covering intended to contain an object. Shells are often, but not necessarily, rigid or semi-rigid structures that are intended to protect the object contained within it.

Speaker: As used in this disclosure, a speaker is an electrical transducer that converts an electrical signal into an audible sound.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Textile: As used in this disclosure, a textile is a material that is woven, knitted, braided or felted. Synonyms in common usage for this definition include fabric and cloth. The two surfaces of the textile with the greatest surface area are called the faces of the textile.

Transducer: As used in this disclosure, a transducer is a device that converts a physical quantity, such as pressure or brightness into an electrical signal or a device that converts an electrical signal into a physical quantity.

USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors. A USB cable refers to a cable that: 1) is terminated with USB connectors; and, 2) that meets the data transmission standards of the USB standard.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The shape of a webbing is approximated by a rectangular disk shape. The two surfaces of a webbing with the greatest surface area are called the faces of the webbing.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An unattended child alert device for vehicle comprising a housing and a control circuit;

wherein the housing contains the control circuit;

wherein the unattended child alert device for vehicle is an electric device;

wherein the unattended child alert device for vehicle monitors and detects changes in inertia;

wherein the unattended child alert device for vehicle monitors makes an audible announcement when a change in inertia is detected;

wherein the audible announcement is a spoken message;

wherein the housing comprises a shell, a plurality of magnets, and a plurality of hook and loop fasteners;

wherein the shell is a rigid casing;

wherein the shell contains the control circuit;

wherein the plurality of magnets magnetically secure the shell to a surface;

wherein each of the plurality of hook and loop fasteners secures the shell to a structure;

wherein the control circuit comprises a logic module, a plurality of transducers, an inertial sensor, and a record switch;

wherein the logic module, the plurality of transducers, the inertial sensor, and the record switch are electrically interconnected;

wherein the shell further comprises a plurality of webbing channels;

wherein each of the plurality of webbing channels is a channel that is formed in the shell;

wherein the logic module is an electric circuit;

wherein the logic module controls the operation of the control circuit;

wherein the logic module controls, monitors, and powers the operation of the plurality of transducers;

wherein the logic module monitors and powers the operation of the inertial sensor;

wherein the logic module monitors the operation of a record switch;

wherein the logic module draws electric energy from the power circuit;

wherein the logic module monitors the inertia of the housing using the inertial sensor;

wherein the logic module generates an audible announcement when the logic module detects a change in the inertia of the inertial sensor using a transducer selected from the plurality of transducers;

wherein the logic module records acoustic energy captured from the exterior of the housing using a transducer selected from the plurality of transducers;

wherein the logic module further comprises a removable memory device and a permanent memory device;

wherein the removable memory device is a memory device;

wherein the removable memory device forms a temporary electrical connection with the logic module;

wherein the logic module controls the operation of the removable memory device;

wherein the removable memory device stores audio files generated by the logic module of the acoustic energy detected by the microphone;

wherein the permanent memory device is a memory device;

wherein the permanent memory device forms a permanent electrical connection with the logic module;

wherein the logic module controls the operation of the permanent memory device;

wherein the permanent memory device stores audio files used by the logic module to generate the audible announcement that is announced over the speaker by the logic module.

2. The unattended child alert device for vehicle according to claim 1 wherein the housing is a rigid casing;

wherein the control circuit monitors and detects a change of inertia in the housing.

3. The unattended child alert device for vehicle according to claim 2 wherein the control circuit is an electric circuit;

wherein the control circuit monitors the inertia of the housing;

wherein the control circuit generates an audible announcement when the control circuit detects a change in the inertia of the housing;

wherein the control circuit records acoustic energy from the exterior of the housing.

4. The unattended child alert device for vehicle according to claim 3 wherein the control circuit is an independently powered electric circuit;

wherein by independently powered is meant that the control circuit can operate without an electrical connection to an external power source.

5. The unattended child alert device for vehicle according to claim 4 wherein the plurality of webbing channels further comprises a first webbing channel and a second webbing channel;

wherein the first webbing channel is a channel that is formed in the shell;

wherein the first webbing channel is sized to receive a first hook and loop fastener selected from the plurality of hook and loop fasteners;

wherein the selected first hook and loop fastener inserts through the first webbing channel to secure the first hook and loop fastener to the first webbing channel;

wherein the second webbing channel is a channel that is formed in the shell;

wherein the second webbing channel is sized to receive a second hook and loop fastener selected from the plurality of hook and loop fasteners;

wherein the selected second hook and loop fastener inserts through the second webbing channel to secure the second hook and loop fastener to the second webbing channel.

6. The unattended child alert device for vehicle according to claim 5 wherein an initial magnet selected from the plurality of magnets attaches to the exterior surface of the shell;

wherein a subsequent magnet selected from the plurality of magnets attaches to the surface to which the unattended child alert device for vehicle attaches;

wherein the plurality of magnets secures the unattended child alert device for vehicle to the surface by placing the initially selected magnet against the subsequently selected magnet.

7. The unattended child alert device for vehicle according to claim 6 wherein the plurality of magnets comprises a first magnet and a second magnet;

wherein the first magnet is a metallic structure that displays magnetic properties;

wherein the first magnet is the initial magnet selected from the plurality of magnets that attaches to the exterior surface of the shell of the housing;

wherein the second magnet is a metallic structure that displays magnetic properties;

wherein the second magnet is the subsequent magnet selected from the plurality of magnets that attaches to a surface;

wherein the first magnet presses against the second magnet to secure the unattended child alert device for vehicle to the surface.

8. The unattended child alert device for vehicle according to claim 7 wherein each of the plurality of hook and loop fasteners is a fastening device;

wherein each of the plurality of hook and loop fasteners attaches to a structure that is selected such that a change in the inertia of the structure would initiate the operation of the audible announcement.

9. The unattended child alert device for vehicle according to claim 8 wherein the plurality of hook and loop fasteners comprises the first hook and loop fastener and the second hook and loop fastener;

wherein the first hook and loop fastener is the hook and loop fastener selected from the plurality of hook and loop fasteners that inserts through the first webbing channel of the shell;

wherein the second hook and loop fastener is the hook and loop fastener selected from the plurality of hook and loop fasteners that inserts through the second webbing channel of the shell;

wherein the first hook and loop fastener secures the shell to an object;

wherein the second hook and loop fastener secures the shell to the object;

wherein the first hook and loop fastener comprises a first webbing and a first ring;

wherein the second hook and loop fastener comprises a second webbing and a second ring;

wherein the first ring attaches to an end of the first webbing;

wherein the second ring attaches to an end of the second webbing.

10. The unattended child alert device for vehicle according to claim 9 wherein the first webbing further comprises a first hook/loop surface and a second hook/loop surface;

wherein the first webbing is a textile-based webbing structure;

wherein the first webbing forms the primary structure of the first hook and loop fastener;

wherein the first webbing attaches to itself using to form a loop that secures the shell to an object;

wherein the first hook/loop surface is a hook/loop surface of the first hook and loop fastener that is formed on a face of the first webbing of the first hook and loop fastener;

wherein the second hook/loop surface is a hook/loop surface of the first hook and loop fastener that is formed on the face of the first webbing of the first hook and loop fastener that is distal from the face that has the first hook/loop surface;

wherein the first ring is a ring structure;

wherein the first ring forms a mechanical structure that allows the first webbing to loop back upon itself;

wherein the second webbing further comprises a third hook/loop surface and a fourth hook/loop surface;

wherein the second webbing is a textile-based webbing structure;

wherein the second webbing forms the primary structure of the second hook and loop fastener;

wherein the second webbing attaches to itself using to form a loop that secures the shell to an object;

wherein the third hook/loop surface is a hook/loop surface of the second hook and loop fastener that is formed on a face of the second webbing of the second hook and loop fastener;

wherein the fourth hook/loop surface is a hook/loop surface of the second hook and loop fastener that is formed on the face of the second webbing of the second hook and loop fastener that is distal from the face that has the third hook/loop surface;

wherein the second ring is a ring structure;

wherein the second ring forms a mechanical structure that allows the second webbing to loop back upon itself.

11. The unattended child alert device for vehicle according to claim 10 wherein the first hook and loop fastener binds the housing to an object by: a) inserting the end of the first webbing that is distal from the first ring through the first webbing channel; b) subsequently inserting the end of the first webbing that is distal from the first ring through the first ring; and then c) pressing the first hook/loop surface against the second hook/loop surface;

wherein the second hook and loop fastener binds the housing to an object by: a) inserting the end of the second webbing that is distal from the second ring through the second webbing channel; b) subsequently inserting the end of the second webbing that is distal from the second ring through the second ring; and then c) pressing the third hook/loop surface against the fourth hook/loop surface.

12. The unattended child alert device for vehicle according to claim 11 wherein each of the plurality of transducers is an electrical device;

wherein each of the plurality of transducers performs a function selected from the group consisting of: a) converting mechanical energy into electrical energy; and, b) converting electrical energy into mechanical energy.

13. The unattended child alert device for vehicle according to claim 12 wherein the inertial sensor is a sensor;

wherein the inertial sensor is a type of force sensor;

wherein the inertial sensor converts changes in the inertia of the housing into electrical signals that are transmitted to the logic module;

wherein the logic module generates the audible announcement when the logic module determines that the inertial sensor had detected a change in inertia;

wherein the logic module generates the audible announcement using the speaker from an audio file that is stored on the permanent memory device of the logic module.

14. The unattended child alert device for vehicle according to claim 13 the record switch is a momentary switch;

wherein the logic module monitors the operation of the record switch;

wherein the actuation of the record switch causes the logic module to begin recording the acoustic energy detected by the microphone into an audio file that is stored on the removable memory device of the logic module;

wherein the actuation of the record switch causes the logic module to discontinue recording the acoustic energy detected by the microphone.

15. The unattended child alert device for vehicle according to claim 14 wherein the power circuit is an electrical circuit;

wherein the power circuit powers the operation of the control circuit;

wherein the power circuit is an electrochemical device;

wherein the power circuit converts chemical potential energy into the electrical energy required to power the control circuit;

wherein the power circuit comprises a battery, a diode, a charging port, and an external power source;

wherein the external power source further comprises an external power source, a second positive terminal, and a second negative terminal;

wherein the battery, the diode, the charging port, the external power source, and the charging port are electrically interconnected;

wherein the battery further comprises a first positive terminal and a second positive terminal.

16. The unattended child alert device for vehicle according to claim 14 wherein the plurality of transducers further comprises a speaker and a microphone;

wherein the speaker is a transducer selected from the plurality of transducers;

wherein the speaker converts electric energy received from the logic module into acoustic energy used to create the audible announcement;

wherein the microphone is a transducer selected from the plurality of transducers;

wherein the microphone converts acoustic energy captured from the exterior of the housing into electrical energy that is transmitted to the logic module;

wherein an LED and a limit resistor are included and are wired to the logic module;

wherein the LED is a two-terminal semiconducting device;

wherein the LED electrically connects to the logic module such that the logic module controls the operation of the LED;

wherein the LED illuminates when the logic module sends an electric current through the LED;

wherein the limit resistor is an electric circuit element that forms a series connection with the LED;

wherein the limit resistor limits the amount of electric energy that flows through the LED;

wherein the battery is a rechargeable battery;

wherein the charging port is an electrical circuit that reverses the polarity of the rechargeable battery;

wherein the charging port forms an electrical connection to an external power source using a charging plug;

wherein the charging plug forms a detachable electrical connection with the charging port;

wherein the charging port receives electrical energy from the external power source through the charging plug;

wherein the diode is an electrical device that allows current to flow in only one direction;

wherein the diode installs between the rechargeable battery and the charging port such that electricity will not flow from the first positive terminal of the rechargeable battery into the second positive terminal of the external power source.

* * * * *